US005775303A

United States Patent [19]

Sweetland et al.

[11] Patent Number: 5,775,303

[45] Date of Patent: Jul. 7, 1998

[54] HIGH PRESSURE FUEL LINE CONNECTION

[75] Inventors: Roger D. Sweetland, Columbus, Ind.; Ralph E. Nelson, Greenville, N.C.

[73] Assignee: Cummins Engine Company, Inc., Columbus, Ind.

[21] Appl. No.: 497,318

[22] Filed: Jun. 30, 1995

[51] Int. Cl.[6] ..... F02M 55/02

[52] U.S. Cl. ..... 123/470; 123/509

[58] Field of Search ..... 123/470, 472, 123/469, 468, 509, 510

[56] References Cited

U.S. PATENT DOCUMENTS

| | | | |
|---|---|---|---|
| 3,247,833 | 4/1966 | Beddoes | 123/470 |
| 3,420,703 | 1/1969 | Dickerson . | |
| 3,783,842 | 1/1974 | Kuhn | 123/470 |
| 3,845,748 | 11/1974 | Eisenberg . | |
| 4,445,713 | 5/1984 | Bruning | 123/469 |
| 4,485,790 | 12/1984 | Nishimura | 123/470 |
| 4,881,763 | 11/1989 | Guido | 123/469 |
| 5,365,907 | 11/1994 | Dietrich et al. . | |

FOREIGN PATENT DOCUMENTS

| | | | |
|---|---|---|---|
| 0569727 | 11/1993 | European Pat. Off. | 123/470 |
| 0627553 | 12/1994 | European Pat. Off. | 123/468 |
| 810963 | 7/1937 | France | 123/469 |
| 4140668 | 7/1992 | Germany | 123/469 |
| 69206268.7 | 10/1993 | Germany | 123/470 |
| 4312936 | 10/1994 | Germany | 123/469 |
| 2023229 | 12/1979 | United Kingdom | 123/470 |

*Primary Examiner*—Carl S. Miller

*Attorney, Agent, or Firm*—Sixbey, Friedman, Leedom & Ferguson; Charles M. Leedom, Jr.; Donald P. Studebaker

[57] ABSTRACT

A high pressure fuel line connection assembly for a fuel injector positioned in a cylinder head of an internal combustion engine is disclosed. The cylinder head includes at least two bores formed therein with the second bore intersecting the first bore at an angle with respect to an axial direction of the first bore. A fuel injector is received in the first bore for injecting fuel into a cylinder of the engine, a fuel line for directing fuel to the fuel injector, an intermediate elongated fuel line adapter are received in the second bore for fluidicly conducting fuel from the fuel line to the fuel injector. The elongated fuel line adapter includes a first end contacting the fuel injector in a region of the fuel injector for receiving fuel to be injected and a fuel line connection fitting for biasing an end of the fuel line against a second end of the adapter and the first end of the adapter against the fuel injector in order to sealingly engage the adapter with both the fuel line and the fuel injector.

20 Claims, 5 Drawing Sheets

HIGH PRESSURE FUEL LINE CONNECTION

TECHNICAL FIELD OF THE INVENTION

The present invention is directed to the high pressure fuel line connection in an internal combustion engine. More particularly, the present invention is directed to a high pressure fuel line connection which is adapted to be received by the cylinder head as well as a fuel injection nozzle of an internal combustion engine.

BACKGROUND OF THE INVENTION

Generally, in a compression ignition engine, the fuel injection nozzle holder is inserted into a vertical bore formed in the cylinder head with the nozzle protruding into the cylinder while the upper end of the holder is projecting from the head for connection to fuel lines. Ductal metal tubes are used to deliver fuel to the nozzle holder from a fuel injection pump and to conduct return fuel away from the holder to the fuel tank. The tubes pass either through the wall of the cylinder head or the cylinder head cover. A common practice is to connect fuel lines permanently to the nozzle holder, for example, by soldering or braising and to provide a break in the lines at a point where they pass through the cylinder head or cover for easy access during maintenance procedures. A connecting fitting is provided at the break point and is constructed such that any fuel leakage from the connection is collected and drained to the fuel supply to avoid contamination of the lubrication oil inside the engine. Such an installation is illustrated in U.S. Pat. No. 3,402,703 issued to Dickerson.

Although careful manufacture of the fuel line components and careful assembly may substantially eliminate fuel leakage in a new engine incorporating the high pressure fuel line connection discussed hereinabove, subsequent operation and wear will ultimately cause loosening of the fittings, thus breaking down the soldered connection and cracking the metal tubing. This will eventually result in undesirable leakage of fuel into the engine lubrication oil compartment. Whenever extra care must be taken to assemble the components of an internal combustion engine, extra expense is necessarily also involved. Further, if only a relatively minor leak occurs under the cylinder head cover, a leakage of fuel trapped in the cylinder head will seek to escape through any opening and most likely into the lubrication oil compartment.

Yet another attempt to avoid the leakage problem includes the use of a long nozzle holder protruding from a sealed hole in the cylinder head cover. This installation permits the fuel line connections to be made outside the cover away from the engine lubrication oil compartment. This installation, however, is very complicated, difficult to service and occupies a significant amount of space in the engine compartment.

In an effort to overcome the aforementioned shortcomings, the fuel injection nozzle holder installation illustrated in U.S. Pat. No. 3,845,748 discloses a fuel line installation including a fuel delivery tube received within a bore which communicates with the nozzle holder through a conical fitting at the end of the tube. A second tube encircles the fuel delivery tube and engages the fitting to maintain it in a conical receiving opening in the nozzle holder. The second tube in turn is held against the conical fitting by an elongated annular fitting also encircling the fuel delivery tube which is screwed into the free end of the bore formed in the cylinder head. In operation, fuel is delivered to the nozzle holder through the fuel delivery tube while any leakage is returned to the fuel supply by conducting it away from the nozzle holder through an annular passage about the outer tubes. Accordingly, in this construction, the pressure tube is pressed into a sealing seat on the nozzle holder by a compression nut which surrounds the fuel line originating from the injection pump and engages the flange structure firmly connected to the fuel line. While the aforementioned assembly provides a single compression nut construction which may be readily removed by removing the single compression fitting, upon removal of the injection plate, the high pressure seal on the nozzle holder is necessary also loosen which can lead to sealing problems upon reassembly of the fuel line.

In a further effort to overcome the above-noted shortcomings, U.S. Pat. No. 5,365,907 issued to Dietrich et al. discloses a high pressure fuel line connection with a fuel injection nozzle being mounted and engaged by a high pressure fuel line disposed in a cylindrical recess wherein the pressure tube is axially forced into firm engagement with the nozzle holder by a hollow compression screw through which the pressure tube extends thereby leaving an exposed end of the pressure tube. This exposed free end projects outwardly from the cylinder head and allows a high pressure fuel line to be mounted onto the free end of the pressure tube by way of a union nut for sealing the high pressure fuel line to the pressure tube. While such an arrangement allows the fuel line to be removed from the pressure tube without breaking the seal between the pressure tube and the injection nozzle, such a connection requires two fittings which thus requires the precision installation of both fittings to minimize any leakage of fuel. Moreover, with the use of two connection fittings, the likelihood of leakage may be doubled. Additionally, the pressure tube is positioned normal to the axial direction of the injection nozzle holder which provides a force component normal to the desired force component of the injection nozzle holder. That is, after installation of the nozzle holder, the high pressure fuel line exerts a force contrary to the desired compression of the injection nozzle holder which may lead to leakage of fuel from the injection nozzle holder into the lubrication oil compartment.

Clearly, there is a need for a high pressure fuel line connection which may be readily assembled without fear of leakage of fuel into the lubrication oil compartment, but which may be readily disassembled for servicing the components of the engine. Further, there is a need for a high pressure fuel line connection which aids in the positioning of the injection nozzle holder so as to further reduce the likelihood of fuel leakage into the lubrication oil compartment.

SUMMARY OF THE INVENTION

A primary object of the present invention is to overcome the aforementioned shortcomings associated with prior art high pressure fuel line connections.

A further object of the present invention is to provide a high pressure fuel line connection which may be readily assembled or disassembled with only a single connection.

Yet another object of the present invention is to provide a high pressure fuel line connection which aids in the positioning of the fuel injection nozzle holder by exerting an axial force component on the holder.

A further object of the present invention is to provide a high pressure fuel line connection which minimizes the possibility of leakage of fuel to the lubrication oil compartment.

A still further object of the present invention is to provide a filter assembly readily positioned within the high pressure fuel line assembly for filtering fuel passing therethrough.

Yet another object of the present invention is to provide a means for readily removing the high pressure fuel line assembly from the cylinder head for permitting removal of the fuel injection nozzle holder.

These, as well as additional advantages of the present invention, are achieved by providing a high pressure fuel line connection assembly for a fuel injector positioned in a cylinder head of an internal combustion engine with the cylinder head having at least two bores formed therein with the second bore intersecting the first bore at an angle with respect to an axial direction of the first bore. A fuel injector received in the first bore for injecting fuel into a cylinder of the engine, a fuel line for directing fuel to the fuel injector and an intermediate elongated fuel line adapter received in the second bore for fluidicly conducting fuel from the fuel line to the fuel injector. The elongated fuel line adapter including a first end contacting the fuel injector in a region of the fuel injector for receiving fuel to be injected and a fuel line connection fitting for biasing an end of the fuel line against a second end of the adapter and the first end of the adapter against the fuel injector in order to sealingly engage the adapter with both the fuel line and the fuel injector.

In a preferred embodiment, the intermediate elongated fuel line adapter is releasably received in the second bore of the cylinder head with the adapter having a length which is less than the length of the second bore formed in the cylinder head, thus minimizing the overall size of the engine.

These, as well as additional advantages of the present invention, will become apparent from the following detailed description when read in light of the several figures.

DETAILED DESCRIPTION OF THE INVENTION

Figure 1:
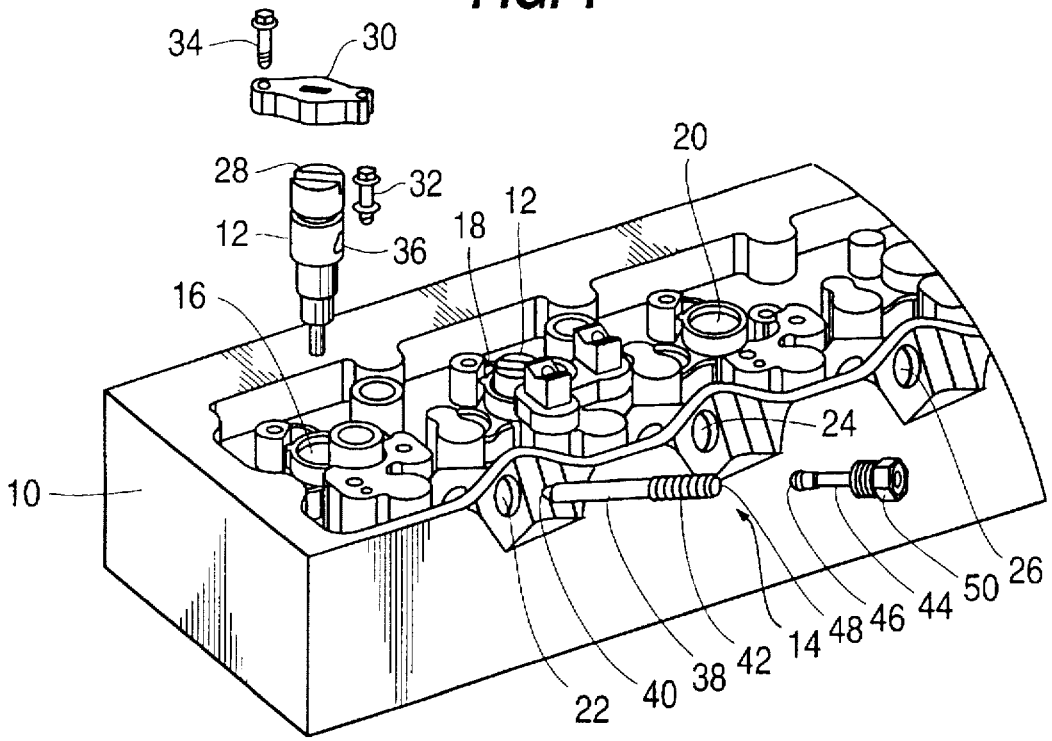
FIG. 1 is a perspective view of the components which form the high pressure fuel line assembly in accordance with the present invention.
Figure 2:
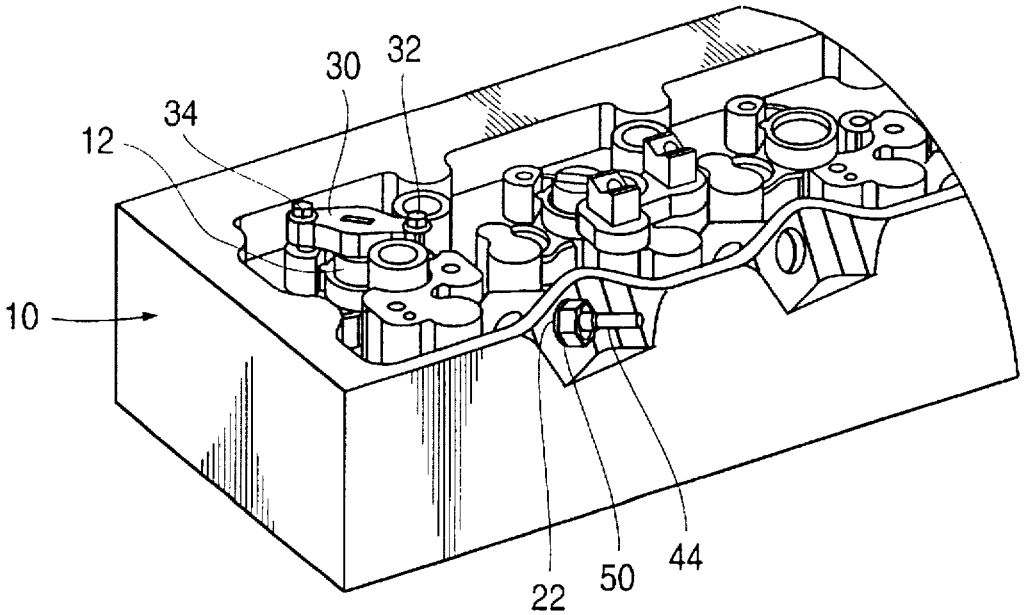
FIG. 2 is a perspective view of the components of FIG. 1 illustrated in their assembled position.

Referring now to the several figures where like reference numerals are used to define like components throughout the embodiments. FIG. 1 illustrates a perspective view of a cylinder head 10 for positioning on an internal combustion engine (not shown) which is adapted to receive the fuel injection nozzle 12 and high pressure fuel line supply assembly 14 in accordance with the present invention. It will be appreciated that the cylinder head 10 as illustrated in FIGS. 1 and 2 is of the in-line type, however, the fuel line assembly of the present invention may be utilized in any known type of internal combustion engine.

The cylinder head 10 includes axially extending bores 16, 18 and 20 illustrated in FIG. 1 for receiving the injection nozzle 12. It can also be appreciated that the while the present invention illustrates an in-line type engine, such an engine may have any number of cylinders, each of which require their own injection nozzle and fuel line assembly. Also provided in the cylinder head 10 are angled bores 22, 24 and 26, each of which are adapted to receive a respective fuel line assembly 14.

The injection nozzle includes an offset slot 28 formed in an upper portion thereof which receives an offset key type clamp 30 which both axially and rotatably positions the injection nozzle 12 within the axial bore 16 of the cylinder head 10. A double flange cap screw 32, as well as bolt 34, are utilized to secure the clamp 30 in place above the injection nozzle 12. Once in place, the injection nozzle is both axially and rotatably fixed within the axial bore 16, this position being illustrated in FIG. 2. Once the injection nozzle 12 is inserted into the axial bore 16, the fuel line assembly is inserted into the angled bore 22 and received by a detent 36 formed in an outer portion of the injection nozzle 12 in a region of the injection nozzle for receiving high pressure fuel to be injected by way of the nozzle. The high pressure fuel line assembly 14 includes an elongated fuel line adapter 38 which is initially inserted into the angled bore 22 with a leading end 40 thereof being received within the detent 36. This being discussed in greater detail hereinbelow. As illustrated, the trailing end 42 of the adapter 38 includes an externally threaded portion, the significance of which will be discussed in greater detail hereinbelow as well.

Fuel line 44 includes a standard flanged fitting 46 which is received within a recessed end 48 of the trailing end 42 of the adapter 38. The flange 46, as well as the adapter 38, are held in place by externally threaded tube nut 50. The tube nut 50, as well as the securing of the adapter 38, in place within the angled bore 22 will be described in greater detail hereinbelow.

As illustrated in FIG. 2, the tube nut 50 is threadingly secured in the angle bore 22 of the cylinder head 10 after the injection nozzle 12 is held in place by the clamp 30. Again, the fuel line assembly will be described in greater detail hereinbelow.

Figure 3:
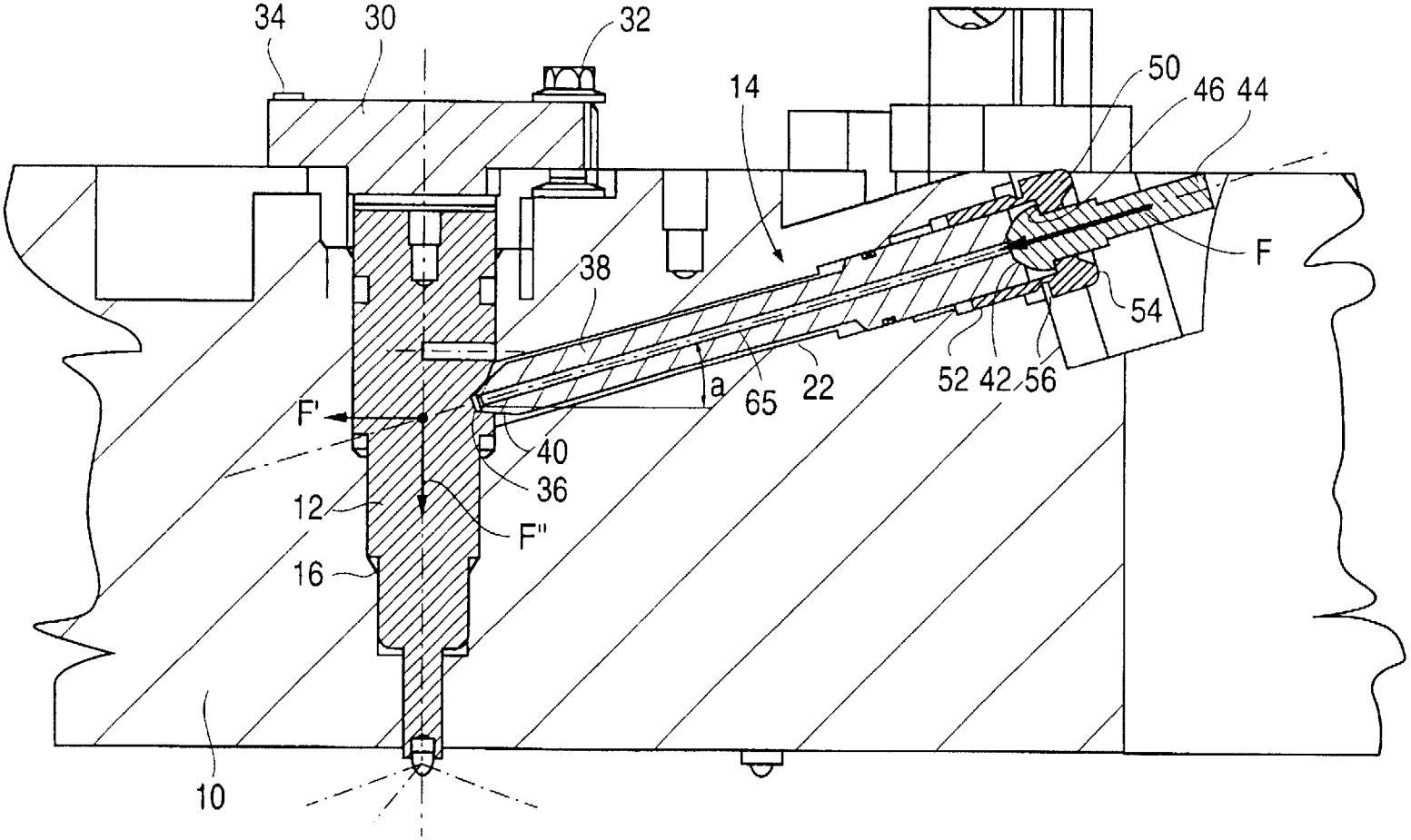
FIG. 3 is a cross-sectional view of the high pressure fuel line in its assembled condition.

Referring now to FIG. 3, wherein the fuel line assembly 14 is in the secured position, it can be seen that only a single securing means in the form of tube nut 50 is used to connect the fuel line 44 to the injection nozzle 12 in order to supply high pressure fuel thereto. As discussed hereinabove, the injection nozzle 12 is positioned in axial bore 16 and clamped into this position by clamp 30 which is secured by cap screw 32 and bolt 34 which are threadingly received by cylinder head 10. Once in this position, the adapter 38 is inserted into the angled bore 22 and into contact with the injection nozzle 12. It can be noted that the diameter of the adapter 38 is slightly less than the angled bore 22 which permits the ease of insertion of the adapter 38 into the angled bore 22 and into contact with the injection nozzle 12 while also providing a leakage flow path which permits any leakage about the adapter 38 to pass in this case downwardly towards the injection nozzle 12 and drained to the fuel supply as is other fuel which leaks from the injection nozzle 12 itself.

Once the adapter 38 is inserted in the angled bore 32, the tube nut 50 which is positioned about the fuel line 44 is threadingly engaged with the cylinder head 10 in the region designated 52 on FIG. 3. An outermost portion 54 of the tube nut 50 includes an annular flange 56 which contacts the flange 46 of the fuel line 44 such that when the tube nut 50 is threaded into the cylinder head 10, an axial compressive force is exerted between the flange 56 and flange 46 in order to press the leading end of the fuel line 44 into engagement with the trailing end 42 of the adapter 38. This in turn forces the leading end 40 of the adapter 38 into the detent 36 formed in the injection nozzle 12. This feature is illustrated in greater detail in FIG. 4.

Figure 4:
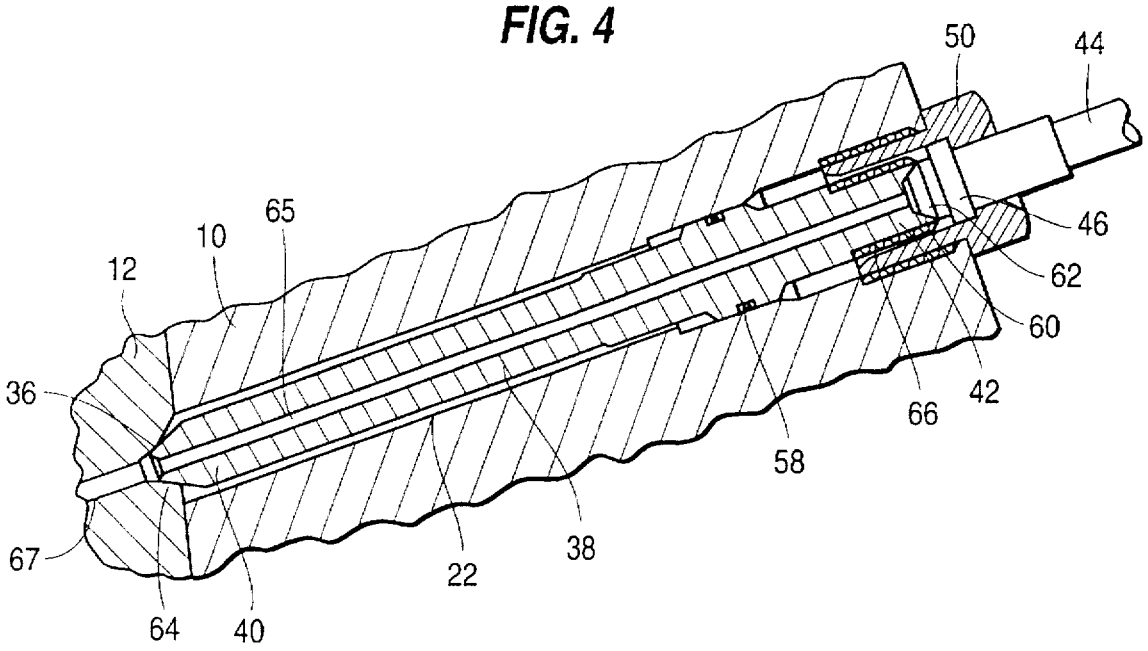
FIG. 4 is an expanded view of the high pressure fuel line adapter illustrated in FIG. 3.

Referring to FIG. 4, it can be noted that an O-ring type seal 58 is provided about the adapter 38 to centrally locate the adapter 38 within the angled bore 22 and to prevent leakage of fuel about the adapter 38. It should be noted from FIG. 4 that the trailing end 42 of the adapter 38 includes a frusto-conical receiving surface 60 forming recess 48 which receives the complementary frusto-conical surface 62 of the flange and 46 of the fuel line 44. Further, the leading end 40 of the adapter 38 includes a frusto-conical surface 64 which is received by the complementary frusto-conical surface of the detent 36. In doing so, the adapter 38 will be aligned within the angled bore 22 so as to form sealing engagement at each end thereof. Further, a flow passage 65 of the adapter 38 will be maintained in alignment with a flow passage 67 formed in the injection nozzle 12 and a flow passage in the fuel line 44 (not shown) so as to permit the flow of high pressure fuel therethrough. It should further be noted from FIG. 4 that while the tube nut 50 threadingly engages the cylinder head 10 at the outer end of the angled bore 22, the tube nut 50 is spaced from threads 66 of the trailing end 42 of the adapter 38 so as not to damage the threads which are used for the removal of the adapter 38 which will be discussed in greater detail hereinbelow.

As is readily apparent from FIG. 3, the central axis of the angled bore 22 and consequently the central axis of the adapter 38 is positioned at an angle a with respect to a line normal to the central axis of the injection nozzle 12. This angle being in the range of 5° to 45° and preferably within the range of 10° to 25°. As illustrated and as utilized in the preferred embodiment, the angle a is approximately 16.5°. In doing so, when a force is applied to a trailing end 42 in the direction of arrow F, force components F' and F" are exerted on the injection nozzle 12. Accordingly, rather than merely exert a force is a horizontal direction on the injection nozzle 12 as with the prior art devices discussed hereinabove, by angling the adapter 38 in the manner illustrated in FIGS. 3 and 4, force component F" acts in the vertical direction, thus aiding in the sealing of the injection nozzle 12 within the axial bore 16. This minimizes the chances of fuel leakage into the engine cylinder causing secondary combustion as well as the introduction of combustion gases about the injection nozzle 12.

Figure 5:
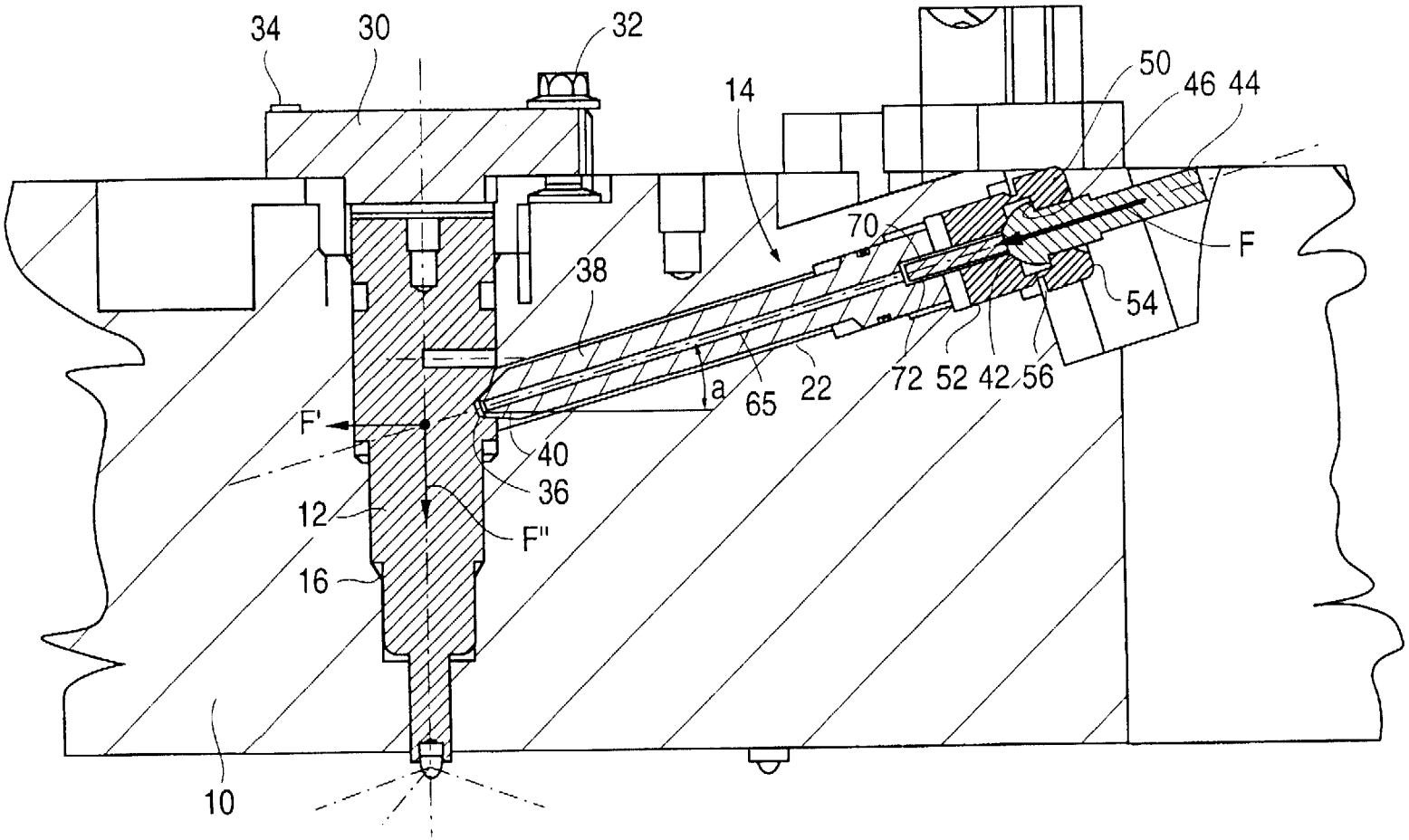
FIG. 5 is a cross-sectional view of the high pressure fuel line assembly in accordance with an alternative embodiment of the present invention.
Figure 6:
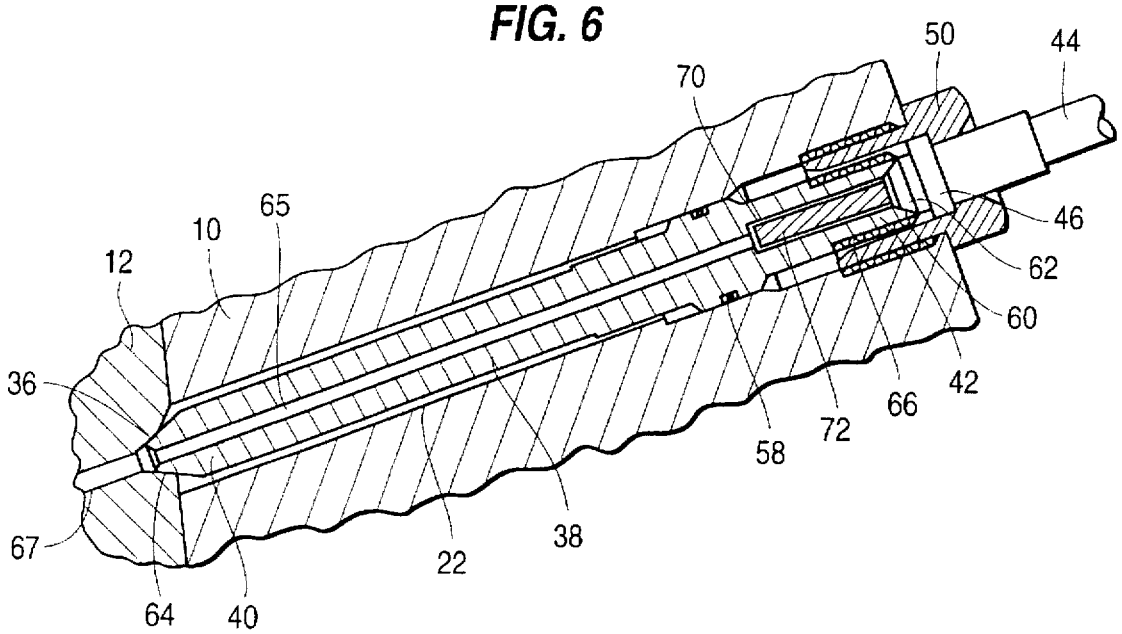
FIG. 6 is an expanded view of the high pressure fuel line adapted illustrated in FIG. 5.

Referring to FIGS. 5 and 6, an alternative embodiment of the present invention will now be described in detail. As with the previous embodiment, FIG. 5 illustrates a perspective view of a cylinder head 10 for positioning on an internal combustion engine (not shown) which is adapted to receive the fuel injection nozzle 12 and high pressure fuel supply assembly 14 in accordance with an alternative embodiment of the present invention. As noted hereinabove, it will be appreciated that the cylinder head 10 as illustrated in FIG. 5 is of the in-line type, however, the fuel line assembly of the present invention may be utilized in any known type of internal combustion engine.

The fuel line assembly 14 is illustrated in the secured position in FIGS. 5 and 6, wherein, as with the previous embodiment, it can be seen that only a single securing means in the form of tube nut 50 is used to connect the fuel line 44 to the injection nozzle 12 in order to supply high pressure fuel thereto. As discussed hereinabove, the injection nozzle 12 is positioned in axial bore 16 and clamped into this position by clamp 30 which is secured by cap screw 32 and bolt 34 which are threadingly received by cylinder head 10. Once in this position, the adapter 38 is inserted into the angled bore 22 and into contact with the injection nozzle 12. Again, it can be noted that the diameter of the adapter 38 is slightly less than the angled bore 22 which permits the ease of insertion of the adapter 38 into the angled bore 22 and into contact with the injection nozzle 12 while also providing a leakage flow path which permits any leakage about the adapter 38 to pass in this case downwardly towards the injection nozzle 12 and drained to the fuel supply as is other fuel which leaks from the injection nozzle 12 itself.

Once the adapter 38 is inserted in the angled bore 32, the tube nut 50 which is positioned about the fuel line 44 is threadingly engaged with the cylinder head 10 in the region designated 52 on FIG. 5. An outermost portion 54 of the tube nut 50 includes an annular flange 56 which contacts the flange 46 of the fuel line 44 such that when the tube nut 50 is threaded into the cylinder head 10, an axial compressive force is exerted between the flange 56 and flange 46 in order to press the leading end of the fuel line 44 into engagement with the trailing end 42 of the adapter 38. This in turn forces the leading end 40 of the adapter 38 into the detent 36 formed in the injection nozzle 12. This feature is illustrated in greater detail in FIG. 6.

Referring to FIG. 6, it can be noted that an O-ring type seal 58 is provided about the adapter 38 to centrally locate the adapter 38 within the angled bore 22 and to prevent leakage of fuel about the adapter 38. It should be noted from FIG. 4 that the trailing end 42 of the adapter 38 includes a frusto-conical receiving surface 60 forming recess 48 which receives the complementary frusto-conical surface 62 of the flange and 46 of the fuel line 44. Further, the leading end 40 of the adapter 38 includes a frusto-conical surface 64 which is received by the complementary frusto-conical surface of the detent 36. In doing so, the adapter 38 will be aligned within the angled bore 22 so as to form sealing engagement at each end thereof. As with the previous embodiment, it should further be noted from FIG. 6 that while the tube nut 50 threadingly engages the cylinder head 10 at the outer end of the angled bore 22, the tube nut 50 is spaced from the threads 66 of the trailing end 42 of the adapter 38 so as not to damage the threads which are used for the removal of the adapter 38 which will be discussed in greater detail hereinbelow.

As with the embodiment illustrated in FIG. 3, the central axis of the angled bore 22 and consequently the central axis of the adapter 38, illustrated in FIG. 5, is positioned at an angle a with respect to a line normal to the central axis of the injection nozzle 12. Again, this angle preferably being in the range of 5° to 45°. As illustrated and as utilized in the preferred embodiment, the angle a is approximately 16.5°. In doing so, when a force is applied to a trailing end 42 in the direction of arrow F, force components F' and F" are exerted on the injection nozzle 12. Again, rather than merely exert a force is a horizontal direction on the injection nozzle 12 as with the prior art devices discussed hereinabove, by angling the adapter 38 in the manner illustrated in FIGS. 5 and 6, force component F" acts in the vertical direction, thus aiding in the sealing of the injection nozzle 12 within the axial bore 16. This minimizes the chances of fuel leakage into the engine cylinder causing secondary combustion as well as the introduction of combustion gases about the injection nozzle 12.

Included in the flow passage 65 of the adapter 38 is an enlarged diameter region 70 which readily receives an edge filter 72 therein. The edge filter 72 being of any known filtering material is positioned centrally within the flow passage 65 so as to filter the fuel passing therethrough. This filter may be readily replaced by simply removing the tube nut 50. Further, the filter 72 can be changed without the removal of the adaptor 38 itself.

Figure 7:
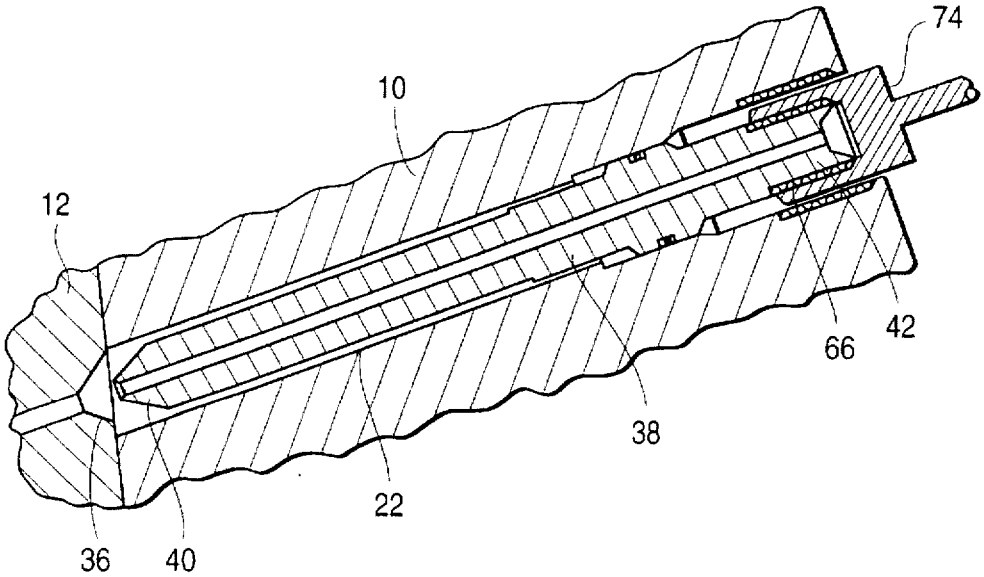
FIG. 7 is cross-sectional view of the high pressure fuel line including a removal device attached thereto.

When it becomes necessary to remove the adaptor 38 from within the bore 22, the tube nut 50 is removed from the cylinder head 10 and a removal tool 74 is threadingly engaged with the outer treads 66 of the adaptor 38 as illustrated in FIG. 7. Once the removal tool 74 is threaded onto the exposed end of the trailing end 42 of the adaptor 38, the adaptor 38 can be removed by pulling outwardly on the removal tool 74. Further, once the adaptor 38 has been at least partially removed from the angled bore 22 and the leading end 40 of the adaptor 38 is withdrawn from the detent 36 formed in the injection nozzle 12, the injection nozzle 12 itself can be removed from the axial bore 16 formed in the cylinder head.

Therefore as can be seen from the foregoing description, a high pressure fuel line connection which may be readily assembled without fear of leakage of fuel into the lubrication oil compartment is set forth. Further, the high pressure fuel line may be readily disassembled for servicing the components of the engine. Also, a high pressure fuel line connection is provided which aids in the positioning of the injection nozzle holder so as to further reduce the likelihood of fuel leakage into the lubrication oil compartment and minimizes the chances of fuel leakage into the engine cylinder causing secondary combustion as well as the introduction of combustion gases about the injection nozzle.

While the present invention is being described with reference to a preferred embodiments, it will be appreciated by those skilled in the art that the invention may be practiced otherwise then as specifically described herein without departing from the spirit and scope of the invention. It is, therefore, to be understood that the spirit and scope of the invention be limited only by the appended claims.

We claim:

1. A fuel line connection assembly for a fuel injector positioned in a cylinder head of an internal combustion engine, the assembly comprising:

a fuel line for directing fuel to the fuel injector;

an intermediate elongated fuel line adapter releasably received in a bore formed in the cylinder head, said adapter having a length less than a length of the bore formed in the cylinder head and having a first end contacting the fuel injector in a fuel receiving region of the fuel injector; and a biasing means for biasing an end of said fuel line against a second end of said elongated member and the first end of said elongated member against the fuel injector.

2. A fuel injection assembly for an internal combustion engine having a cylinder head, said assembly comprising:

a fuel injection means positioned in a first bore formed in the cylinder head for injecting fuel into a cylinder of the engine;

a fuel line for directing fuel to said fuel injection means;

an intermediate elongated fuel line adapter positioned in a second bore formed in the cylinder head; and a unitary securing means for substantially simultaneously securing a first end of said adapter in fluid communication with said fuel injection means and a first end of said fuel line in fluid communication with a second end of said adapter.

3. A fuel line connection assembly for an internal combustion engine comprising:

a cylinder head having at least a first bore and a second bore, said second bore intersecting said first bore at an angle with respect to said first bore;

a fuel injection means received in said first bore for injecting fuel into a cylinder of the engine;

a fuel line for directing fuel to said injection means;

an intermediate elongated fuel line adapter means received in said second bore for fluidicly conducting fuel from said fuel line to said injection means, a first end of said adapter means contacting said injection means in a region of said injection means for receiving fuel to be injected; and a unitary biasing means for biasing an end of said fuel line against a second end of said adapter means, said first end of said adapter means against said injection means and a first end of said fuel injection means against an injection end of said first bore.

4. The assembly as defined in claim 3, wherein a length of said adapter means is less than a length of said second bore.

5. The assembly as defined in claim 3, wherein the angle of intersection between said first bore and said second bore is in a range of 5° to 45° in a substantially axial plane with respect to said first bore.

6. The assembly as defined in claim 5, wherein the angle of intersection between said first bore and said second bore is approximately 16.5°.

7. The assembly as defined in claim 1, wherein said a unitary biasing means includes external threads and said second bore includes cooperating internal threads for receiving the external threads of said a unitary biasing means for forcibly securing said fuel line against the second end of the adapter means and the first end of the adapter means against said injection means.

8. The assembly as defined in claim 2, wherein said second bore intersects said first bore at a non-perpendicular angle with respect thereto.

9. The assembly as defined in claim 8, wherein the angle of intersection between said first bore and said second bore is in a range of 5° to 45°.

10. The assembly as defined in claim 9, wherein the angle of intersection between said first bore and said second bore is approximately 16.5°.

11. The assembly as defined in claim 8, wherein a length of said adapter means is less than a length of said second bore.

12. The assembly as defined in claim 8, wherein said securing means includes external threads and said second bore includes cooperating internal threads for receiving the external threads of said securing means for forcibly securing said fuel line against the second end of the adapter means and the first end of the adapter means against said injection means.

13. The assembly as defined in claim 1, wherein said biasing means includes external threads and said second bore includes cooperating internal threads for receiving the external threads of said biasing means for forcibly securing said fuel line against the second end of the adapter means and the first end of the adapter means against said injection means.

14. The assembly as defined in claim 1, wherein said cylinder head includes a fuel injection assembly bore and said bore for receiving said adapter intersects said fuel injection assembly receiving bore at a non-perpendicular angle with respect thereto.

15. The assembly as defined in claim 14, wherein the angle of intersection between said bores is in a range of 5° to 45°.

16. The assembly as defined in claim 15, wherein the angle of intersection between said bores is approximately 16.5°.

17. The assembly as defined in claim 3, wherein said adapter includes a filter means therein for filtering fuel passing through said adapter.

18. The assembly as defined in claim 2, wherein said adapter includes a filter means therein for filtering fuel passing through said adapter.

19. The assembly as defined in claim 1, wherein said adapter includes a filter means therein for filtering fuel passing through said adapter.

20. The assembly as defined in claim 1, wherein said angle is a non-perpendicular angle in a substantially axial plane with respect to said first bore.

* * * * *